US012078156B2

(12) United States Patent
Jarman et al.

(10) Patent No.: US 12,078,156 B2
(45) Date of Patent: Sep. 3, 2024

(54) PISTON BALL END

(71) Applicant: Hamilton Sundstrand Corporation, Charlotte, NC (US)

(72) Inventors: Jecee Jarman, Pueblo, CO (US); Zachary Allen Ray Le Duc, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 18/155,670

(22) Filed: Jan. 17, 2023

(65) Prior Publication Data

US 2024/0240624 A1 Jul. 18, 2024

(51) Int. Cl.

| | |
|---|---|
| ***F04B 1/24*** | (2006.01) |
| ***F04B 1/126*** | (2020.01) |
| *F04B 3/00* | (2006.01) |

(52) U.S. Cl.

CPC ..... *F04B 1/24* (2013.01); *F04B 1/126* (2013.01); *F04B 3/006* (2013.01)

(58) Field of Classification Search

CPC ..... F04B 1/24; F04B 1/126; F04B 3/006

See application file for complete search history.

(56) References Cited

U.S. PATENT DOCUMENTS

| | | | | |
|---|---|---|---|---|
| 4,806,040 A | | 2/1989 | Gill et al. | |
| 4,966,108 A | * | 10/1990 | Bentz | F01L 1/146 384/907.1 |
| 2012/0291625 A1 | | 11/2012 | Habibvand | |

FOREIGN PATENT DOCUMENTS

| | | | | |
|---|---|---|---|---|
| CN | 110617190 A | * | 12/2019 | F04B 1/124 |
| DE | 1278248 B | | 9/1968 | |
| DE | 10011206 C2 | | 11/2002 | |
| DE | 102012222172 A1 | | 6/2014 | |
| JP | H08247021 A | | 9/1996 | |
| JP | 2010001990 A | | 1/2010 | |

OTHER PUBLICATIONS

English Translation CN-110617190-A (Year: 2019).*

Extended European Search Report for EP Application No. 24152428.9, dated May 27, 2024, 7 pages.

* cited by examiner

*Primary Examiner* — Shafiq Mian

(74) *Attorney, Agent, or Firm* — Kinney & Lange, P.A.

(57) ABSTRACT

In accordance with at least one aspect of this disclosure, a system includes, a cylinder barrel configured to rotate within a pump housing of a pump operatively connected to a driving member of the pump via a first shaft. A piston is seated within a bore defined in the cylinder barrel. The piston is operatively connected to the driving member of the pump via a second shaft. The first shaft and the second shaft each include a ball end configured to seat within the driving member. In embodiments, the ball end of at least the second shaft is of silicon nitride.

13 Claims, 1 Drawing Sheet

Fig. 1
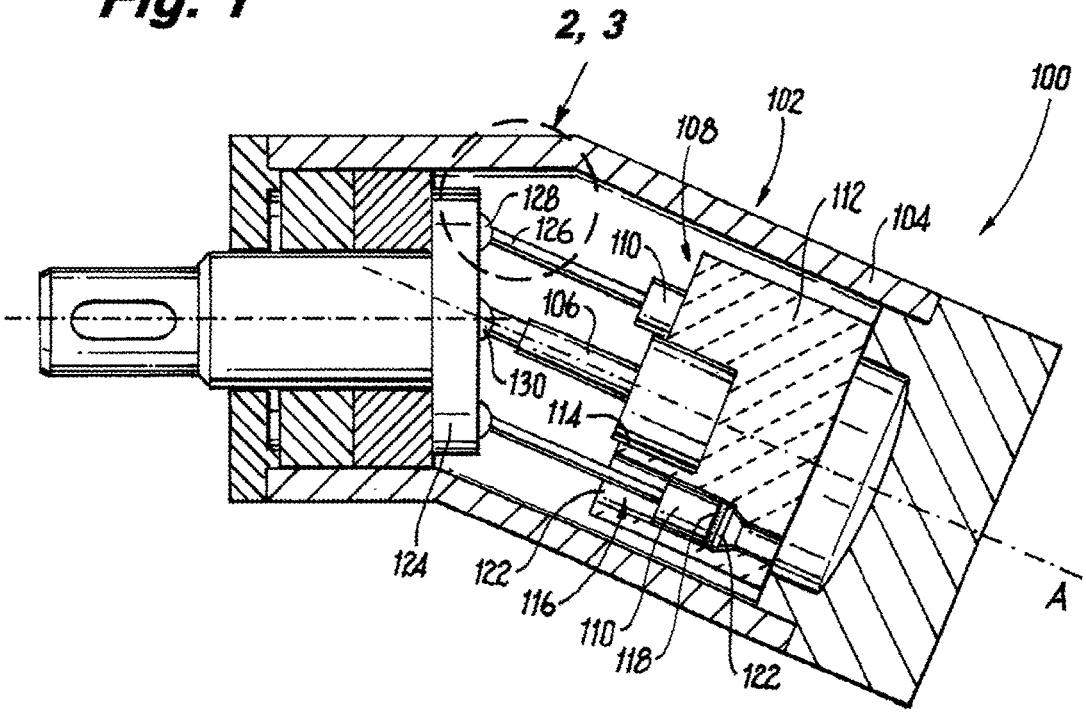
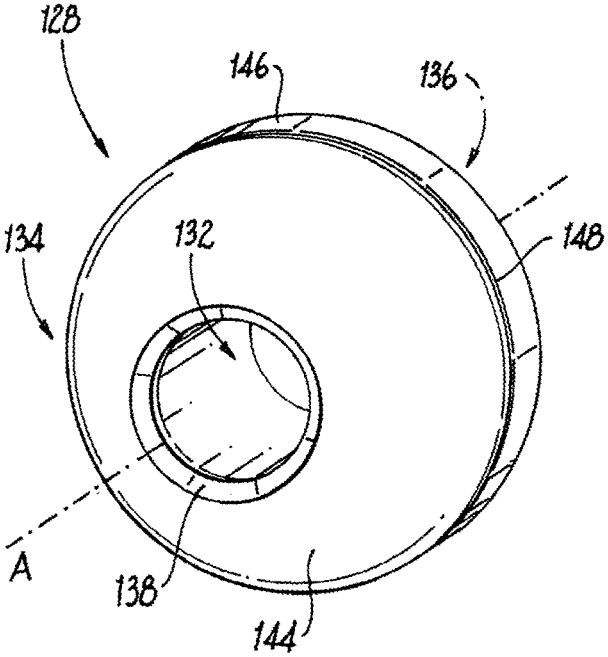
Fig. 2
Fig. 3
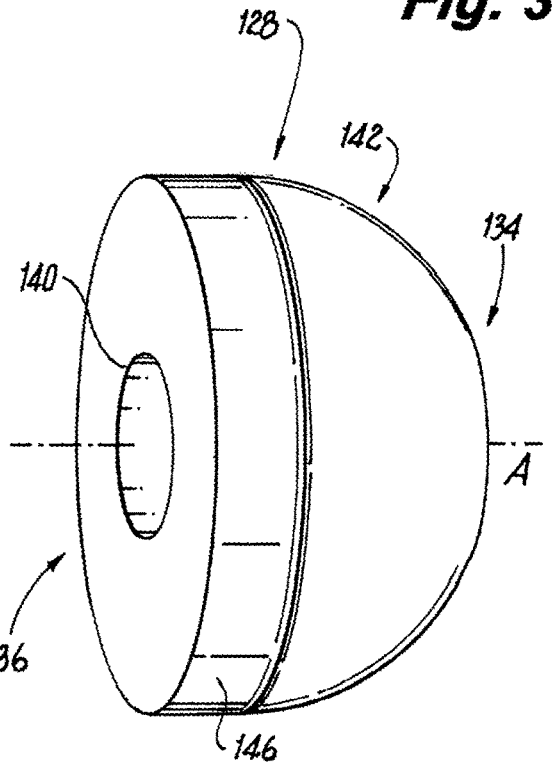

PISTON BALL END

TECHNICAL FIELD

The present disclosure relates to pumps, in particular, ball ends for pistons in pumps.

BACKGROUND

Traditional pistons and associated shafts, e.g., for piston pumps, are made of tungsten carbide, which provides excellent wear resistance in a fuel pump application. However, tungsten carbide components can also be very dense and heavy, which can be a draw back in certain applications where the weight of the components must be carefully considered.

There remains a need for a highly wear resistant material which is lighter and/or less dense than traditional materials. This disclosure provides a solution for this need.

SUMMARY

In accordance with at least one aspect of this disclosure, a system includes, a cylinder barrel configured to rotate within a pump housing of a pump operatively connected to a driving member of the pump via a first shaft. A piston is seated within a bore defined in the cylinder barrel. The piston is operatively connected to the driving member of the pump via a second shaft. The first shaft and the second shaft each include a ball end configured to seat within the driving member. In embodiments, the ball end of at least the second shaft is of silicon nitride.

In embodiments, the ball end can include a bore therethrough defined along a shaft axis extending from a first end of the ball end to a second end of the ball end. An edge of the bore proximate the first end of the ball end can have a rounded edge, and an edge of the bore proximate the second end of the ball end can have a corner, a rounded edge, or a chamfer. In embodiments, a first portion of an outer surface of the ball end can be rounded, where the first portion extends from the first end of the ball end, radially outward from the bore, to a transition point. A second portion of the outer surface of the ball end can be flat, where the second portion extends from the transition portion, parallel to the bore, to the second end of the ball end.

In embodiments, the system can further include the pump. In certain embodiments, the driving member of the pump can be of tool steel. In certain embodiments, the driving member can be of tungsten carbide. In certain embodiments, e.g., where the driving member is of tool steel, the friction coefficient between the ball end of the second shaft and the driving member of the pump can be about 0.11.

In embodiments, the cylinder barrel can include a main cylindrical body; a center recess defined within the main cylindrical body configured to seat the first shaft therein, and a plurality of bores defined in the main cylindrical body configured to allow fluid flow therethrough, and axial translation of the pistons therein. Each respective bore can extend in an axial direction, and can be spaced apart circumferentially relative to one another about the main cylindrical body radially outward of the center recess. The piston can be a plurality of pistons, each piston seated within a respective a respective bore of the plurality of bores. In certain embodiments, the main cylindrical body can be of tool steel. In certain embodiments, the main cylindrical body can be of tungsten carbide. In certain embodiments, the main cylindrical body can by of silicon nitride.

In certain embodiments, the pump can be or can include a piston pump. In certain embodiments, the piston pump can be or include a bent axis variable displacement piston pump. In certain embodiments, the plurality of bores can include at least 7 bores, and up to 13 bores. In certain embodiments, and the plurality of pistons can include at least 7 pistons and up to 13 pistons.

In accordance with at least one aspect of this disclosure, a method can include forming a cylinder barrel of a piston pump, forming a plurality of pistons configured to be inserted into the cylinder barrel, each piston including a shaft having a ball end at a distal end thereof, the ball end being of silicon nitride, and installing the cylinder barrel and plurality of pistons into the piston pump.

In embodiments, forming the cylinder barrel can include forming a main cylindrical body, forming a center recess configured to seat a drive shaft therein, and forming a plurality of bores each extending in an axial direction through the main cylindrical body, the plurality of bores forming a pattern disposed circumferentially about the main cylindrical body radially outward of the center recess, configured to seat a respective piston therein and allow fluid flow therethrough.

In embodiments, installing the cylinder barrel and plurality of pistons into the piston pump can further include, inserting a proximal end of each piston to a respective bore of the plurality of bores, inserting the ball end of each piston shaft into a driving member of the pump, and inserting a drive shaft of the cylinder barrel into the center recess and inserting a ball end of the drive shaft into the driving member of the pump. In certain embodiments, the ball end of the drive shaft can be of silicon nitride. In embodiments, the method can include operating the pump.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 1 is a schematic cross sectional side elevation view of a system in accordance with this disclosure, showing an embodiment of a pump;

FIG. 2 is a front-end perspective view of an embodiment of a ball end of a piston shaft of the pump of FIG. 1; and FIG. 3 is a side elevation view of the ball end of FIG. 2.

DETAILED DESCRIPTION

Reference will now be made to the drawings wherein like reference numerals identify similar structural features or aspects of the subject disclosure. For purposes of explanation and illustration, and not limitation, an illustrative view of an embodiment of a system in accordance with the disclosure is shown in FIG. 1 and is designated generally by reference character 100. Other embodiments and/or aspects of this disclosure are shown in FIGS. 2-3.

In accordance with at least one aspect of this disclosure, e.g., as shown in FIG. 1, a system 100 can include a pump 102. In embodiments, the pump 102 can be or include a piston pump, and in certain embodiments, the pump can be or include a bent axis variable displacement piston pump (e.g., shown in FIG. 1). The pump 102 can include, at least, a pump housing 104, a drive shaft 106, a cylinder barrel 108, and a plurality of pistons 110. The cylinder barrel 108 can be operatively connected to the drive shaft 106 to rotate within the pump housing 104.

With reference now to FIG. 1, in embodiments, the cylinder barrel 108 can include a main cylindrical body 112 defining a barrel axis. In certain embodiments, the main cylindrical body can be formed monolithically. A center recess 114 can be defined within the main cylindrical body 112 configured to seat the drive shaft 106 therein, along the barrel axis A. A plurality of bores 116 can be defined in the main cylindrical body 112, extending in an axial direction through the main cylindrical body 112 (e.g., in a direction parallel to the barrel axis A). As shown, the plurality of bores 116 can be spaced apart circumferentially relative to one another about the main cylindrical body 112, and radially outward of the center recess 114. Each of the plurality of bores 116 can be configured to seat a respective piston therein (e.g., piston 110) and allow fluid flow therethrough. During operation of the pump 102, the respective pistons 108 translate axially along the barrel axis A within the respective bores 116 to selectively change an amount of flow through the respective bore 116, and ultimately the total displacement through the pump 102. In certain embodiments, the plurality of bores 116 can include at least 7 bores, for example, and up to 13 bores. An embodiment of the cylinder barrel 108 having 9 bores 116 is shown. Any suitable number of bores 116 is contemplated herein.

In embodiments, each respective piston 110 further includes a piston ring 118 disposed at an end 120 thereof (or integrally formed thereon at an end 120 thereof) configured to form a hydrodynamic seal with an inner surface 122 of the respective bore 116. In certain embodiments, the piston 110 can be of tool steel and the piston ring 118 can be of tool steel. In certain embodiments, only the piston ring 118 is of tool steel. In embodiments, the main cylindrical body 108 can be any one or more of silicon nitride, tool steel, or tungsten carbide. The selection of materials for the main cylindrical body 108 and the piston rings 118 can be selected for reduction of friction coefficient between the two materials, for example.

In embodiments, the cylinder barrel 108 can be connected to a driving member 124 (e.g., a shoulder shaft) of the pump 100 via a first shaft (e.g., drive shaft 106). Each piston can be operatively connected to the driving member 124 of the pump via a second shaft (e.g., a piston shaft) 126. The drive shaft 106 and the piston shaft 126 each include a ball end 128, 130 configured to seat within the driving member 124. In embodiments, the ball end 128 of at least the piston shaft 126 is of silicon nitride. In embodiments, it is contemplated the ball end 130 of the drive shaft 106 can also be of silicon nitride.

In embodiments, as shown in FIGS. 2 and 3, the ball end 128 can include a bore 132 therethrough defined along a shaft axis A (which can be coaxial or parallel with the barrel axis A) extending from a first end 134 of the ball end 128 to a second end 136 of the ball end 128. An edge 138 of the bore 132 proximate the first end 132 of the ball end 128 can have a rounded edge, and an edge 140 of the bore 132 proximate the second end 134 of the ball end can have a corner (e.g. a 90 degree edge) or, in certain embodiments, the edge 140 could be chamfered or rounded. In embodiments, an outer wear surface 142 of the ball end 128 can define a first portion 144 and a second portion 146. In embodiments, e.g., as shown, the first portion 144 can be rounded, extending from the first end 134 of the ball end 128, curving radially outward and away from the bore 132, to a transition point 148. The second portion 146 can be flat, extending from the transition point 148, parallel to the bore 132 and shaft axis A, to the second end 136 of the ball end 128.

In certain embodiments, the driving member 124 of the pump 100 can be of tool steel. In certain embodiments, the driving member 124 can be of tungsten carbide. In certain embodiments, e.g., where the driving member 124 is of tool steel, the friction coefficient between the ball end 128 of the second shaft and the driving member 124 of the pump can be about 0.11. While embodiments are described herein with respect to ball end 128 of the piston shaft 126, it is contemplated that the ball end 130 can be the same or similar to that of ball end 128. An embodiment utilizing a driving member 124 of tungsten carbide mated to a ball end 128 of tool steel would have mating interfaces which wear. As wear occurs, tungsten carbide and tool steel mating interfaces can become poorly lubricated and increase in friction coefficient towards unlubricated values of 0.19. Although the wear life of silicon nitride on tool steel has been shown to be an order of magnitude higher than tungsten carbide-tool steel interfaces, as wear occurs between silicon nitride ball ends 128 and tool steel driving members 124, the friction coefficient will tend towards an unlubricated value of about 0.15 (about a 25% decrease compared to the unlubricated tungsten carbide-tool steel value of about 0.19).

In accordance with at least one aspect of this disclosure, with reference to FIGS. 1-3, a method can include forming a cylinder barrel (e.g., cylinder barrel 108) of a piston pump (e.g., pump 102), and installing the cylinder barrel into the piston pump. In embodiments, forming the cylinder barrel can further include, forming a main cylindrical body (e.g., body 112), forming a center recess (e.g., recess 114) configured to seat a drive shaft therein, forming a plurality of bores (e.g., bores 116) each extending in an axial direction through the main cylindrical body, the plurality of bores forming a pattern disposed circumferentially about the main cylindrical body radially outward of the center recess, configured to seat a respective piston (e.g., piston 110) therein and allow fluid flow therethrough.

In embodiments, the method can further include, forming a plurality of pistons (e.g., pistons 110) configured to be inserted into the cylinder barrel, each piston including a shaft (e.g., piston shaft 126) having a ball end (e.g., ball end 128) at a distal end thereof (e.g., opposite the shaft from the piston and cylinder barrel), the ball end being of silicon nitride, and installing the cylinder barrel and plurality of pistons into the piston pump.

In embodiments, installing the cylinder barrel and plurality of pistons into the piston pump can further include, inserting a proximal end of each piston to the respective bore of the plurality of bores, inserting the ball end of each piston shaft into a driving member (e.g., driving member 124) of the pump, and inserting a drive shaft (e.g., shaft 106) of the cylinder barrel into the center recess and inserting a ball end of the drive shaft into the driving member of the pump. In certain embodiments, the ball end of the drive shaft can be of silicon nitride. In embodiments, the method can include operating the pump.

Embodiments provide for a lower density piston ball end, which can reduce the overall weight of the pump. The silicon nitride piston ball end is configured to withstand the load demands of the pump. Embodiments having a silicon nitride piston ball end are naturally more lubricious based on material and wear properties silicon nitride derives from its crystal structure. In combination with its lubricity, engineered versions of silicon nitride can have high strength and high toughness to survive service conditions and also reduce part degradation which provides slower wearing piston ball ends which are rotated or rubbed against mated surfaces (e.g., in the driving member). This can increase the total number service hours of the pistons and associated shafts and even the pump as a whole.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the apparatus and methods of the subject disclosure have been shown and described, those skilled in the art will readily appreciate that changes and/or modifications may be made thereto without departing from the scope of the subject disclosure.

What is claimed is:

1. A system, comprising:

a cylinder barrel configured to rotate within a pump housing of a pump operatively and directly connected to a driving member of the pump via a first shaft;

a piston seated within a bore defined in the cylinder barrel, the piston operatively and directly connected to the driving member of the pump via a second shaft, wherein the first shaft and the second shaft include a ball end configured to seat within the driving member, wherein the ball end of at least the second shaft is of silicon nitride.

2. The system of claim 1, further comprising the pump.

3. The system of claim 2, wherein the driving member of the pump is of tool steel.

4. The system of claim 3, wherein a friction coefficient between the ball end of the second shaft and the driving member of the pump is about 0.11.

5. The system of claim 3, wherein the ball end includes a bore therethrough defined along a shaft axis extending from a first end of the ball end to a second end of the ball end, wherein an edge of the bore proximate the first end of the ball end includes a rounded edge, and wherein an edge of the bore proximate the second end of the ball end includes corner.

6. The system of claim 5, wherein a first portion of an outer surface of the ball end is rounded, wherein the first portion extends from the first end of the ball end, radially outward from the bore, to a transition point, wherein a second portion of the outer surface of the ball end is flat, wherein the second portion extends from the transition portion, parallel to the bore, to the second end of the ball end.

7. The system of claim 1, wherein the pump is or includes a piston pump.

8. The system of claim 7, wherein the piston pump is or includes a bent axis variable displacement piston pump.

9. The system of claim 1, further including a plurality of bores and a plurality of pistons, wherein the plurality of bores includes at least 7 bores and the plurality of pistons includes at least 7 pistons.

10. The system of claim 9, wherein the plurality of bores includes up to 13 bores and the plurality of pistons includes up to 13 pistons.

11. A method comprising:

forming a cylinder barrel of a piston pump;

forming a plurality of pistons configured to be inserted into the cylinder barrel, each piston including a shaft having a ball end at a distal end thereof, the ball end being of silicon nitride; and installing the cylinder barrel and plurality of pistons into the piston pump, herein forming the cylinder barrel further includes, forming a main cylindrical body;

forming a center recess configured to seat a drive shaft therein; and forming a plurality of bores each extending in an axial direction through the main cylindrical body, the plurality of bores forming a pattern disposed circumferentially about the main cylindrical body radially outward of the center recess, configured to seat a respective piston therein and allow fluid flow therethrough.

12. The method of claim 11, wherein installing the cylinder barrel and plurality of pistons into the piston pump further includes, inserting a proximal end of each piston to a respective bore of the plurality of bores;

inserting the ball end of each piston shaft into a driving member of the pump; and inserting a drive shaft of the cylinder barrel into the center recess and inserting a ball end of the drive shaft into the driving member of the pump.

13. The method of claim 12, further comprising, operating the pump.

* * * * *